US005305620A

United States Patent [19]

Yabuta

[11] Patent Number: 5,305,620

[45] Date of Patent: Apr. 26, 1994

[54] FLAT KNITTING MACHINE

[75] Inventor: Masahiro Yabuta, Wakayama, Japan

[73] Assignee: Shima Seiko Mfg. Ltd., Wakayama, Japan

[21] Appl. No.: 945,486

[22] Filed: Sep. 16, 1992

[30] Foreign Application Priority Data

Sep. 17, 1991 [JP] Japan ..... 3-265286

[51] Int. Cl.[5] ..... D04B 7/00; D04B 15/36

[52] U.S. Cl. ..... 66/109; 66/64

[58] Field of Search ..... 66/64, 78, 109, 70, 66/60 R, 121

[56] References Cited

U.S. PATENT DOCUMENTS 1,676,947 7/1928 Frazier ..... 66/64

4,474,037 10/1984 Kühnert ..... 66/64

*Primary Examiner*—Clifford D. Crowder

*Assistant Examiner*—John J. Calvert

*Attorney, Agent, or Firm*—Spensley Horn Jubas & Lubitz

[57] ABSTRACT

A flat knitting machine which can carry out changing of knock over timing and changing of an elevating amount of a needle, in which a knock-over plate provided at its extreme end with a loop pressing plate having an end edge in contact with a knitting yarn is inserted into a bottom of a needle groove of a head portion of a needle bed so that the knock over plate can be slidably moved in a direction of forward and backward movement of a needle. Further, a knock over plate cam for operating the knock over plate in engagement with the knock over plate is provided on a carriage, and the knock over plate is moved forward and backward by the cam.

4 Claims, 4 Drawing Sheets

FLAT KNITTING MACHINE

BACKGROUND OF THE INVENTION

1. Field of the Invention

The present invention relates to a flat knitting machine in which a needle at the time of knitting knitted fabrics can adjust timing of its elevating stroke and a knock over for drawing a new loop from an old loop.

2. Prior Art

In a needle bed of a flat knitting machine, needle plates are inserted into grooves provided parallel on a needle bed base plate, a needle groove is formed between the needle plates adjacent to each other, and a needle is slidably inserted into the needle groove. A sinker is locked at an extreme end of the needle bed base plate at the same pitch and the same phase as that of the needle plate and connected by a sinker wire. A knitting yarn supporting wire is secured to a tooth mouth (a center line of the confronting needle beds) parallel with the extreme end of the needle bed base plate, and the needle fed with a yarn at a raising position moves down while engaging the knitting yarn with a hook, is contacted with the knitting yarn supporting wire passing through the old loop at a knock over position.

A raising amount of the needle for receiving a feed of the knitting yarn is a position at which a latch of the raising needle is escaped from the old loop engaged with a shank and an extreme end of the latch is moved up in a predetermined amount from the position escaped from the old loop. This position is a position at which the latch can be surely moved away from the old loop. Accordingly, this position can be suitably selected to control the raising amount of the needle.

When a next new stitch is formed, timing of the knock over of the knitting yarn in the form of a loop engaged with a hook of the needle which moves backward in the needle groove is different in dependency of a position where the needle contacts with the knitting yarn supporting wire. The timing is fast as the knitting yarn supporting wire is positioned at the extreme end of the needle bed and slow as it enters from the head of the needle bed. Timing of this knock over varies with the kind of the knitting yarn, thickness of the yarn and the like, and it is desirable to adjust the knock over timing whenever they change.

It has been contemplated that in order to change a position of the knitting yarn supporting wire, a plurality of small holes through which the knitting yarn supporting wire is inserted are provided in a sinker to which the knitting yarn supporting wire is secured so that the inserting position of the knitting yarn supporting wire is suitably changed. According to this means, adjustment of timing of the knock over is carried out stepwise and is not carried out continuously. Further, it takes time for the work for changing the position of the knitting yarn supporting wire.

OBJECT AND SUMMARY OF THE INVENTION

An object of the present invention is to provide a flat knitting machine which can continuously carry out changing of timing of a climbing stroke of a needle and or knock-over.

According to the present invention, a knock over plate provided with a loop pressing plate having an end edge in contact with a knitting yarn at its extreme end is inserted into a bottom of a needle groove of a head portion of a needle bed so that the knock over plate can be slidably moved in a direction of forward and backward movement of a needle. A knock over plate cam for operating the knock over plate in engagement with a knock over plate is provided on a carriage so that the knock over plate is moved forward and backward by the cam. Furthermore, a position of the knock over plate cam is movable so that a moving amount of the knock over plate in engagement with the cam can be varied.

The knock over plate inserted into the bottom of the needle groove of the head portion of the needle bed is inserted into the bottom of the needle groove in a state where the contact end edge of the loop pressing plate provided at the extreme end thereof is protruded from the needle bed base plate. Accordingly, the forward and backward movement of the knock over plate of the present invention may cause the knock over plate to be brought into contact with a knock over plate butt provided integral with the knock over plate to change the position of the contact end edge with the knitting yarn.

BRIEF DESCRIPTION OF THE DRAWINGS

FIG. 1*a* is a longitudinal sectional view and FIG. 1*b* is a plan view.

FIG. 3*a* is a plan view.

DETAILED DESCRIPTION OF PREFERRED EMBODIMENT

One embodiment of the apparatus according to the present invention will be described hereinafter with reference to the drawings.

Figure 1B:
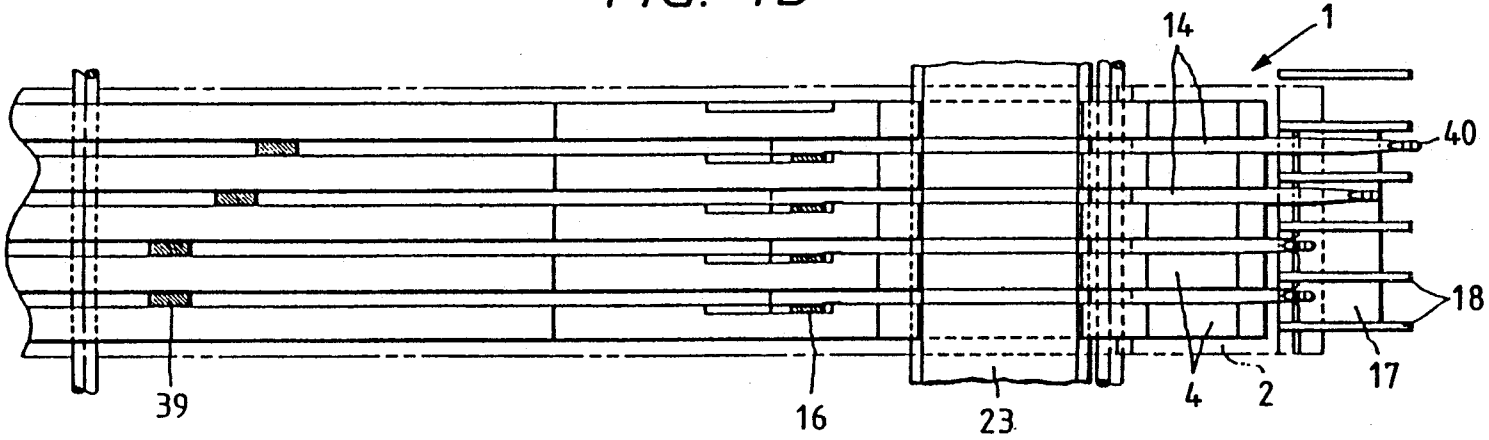
Figure 1A:
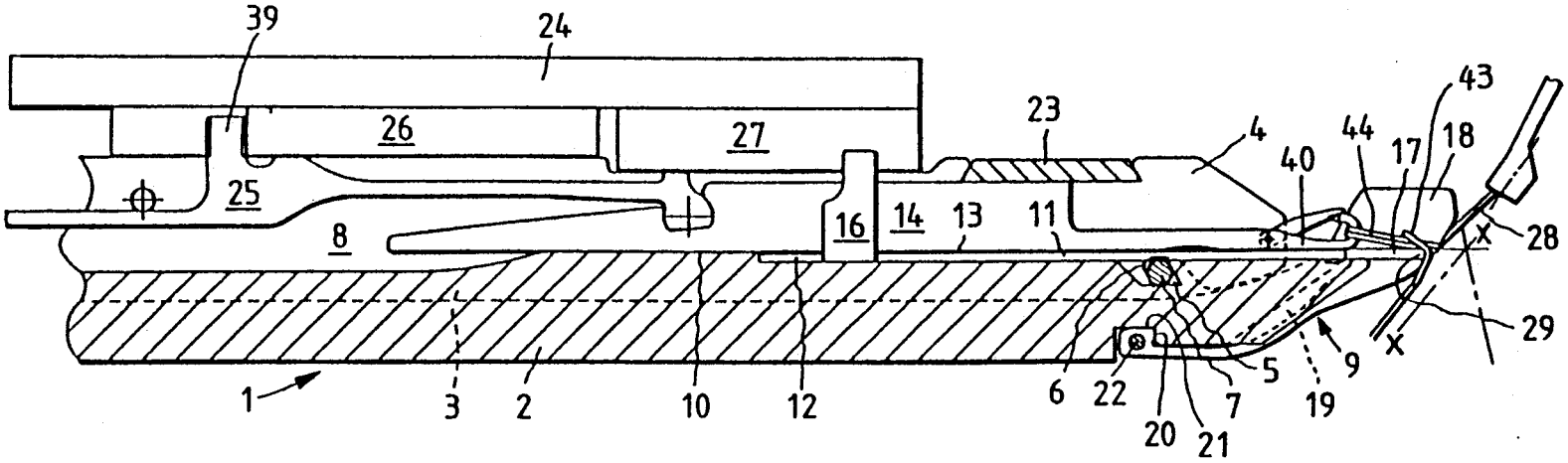
FIGS. 1*a, b* shows the apparatus of the present invention.
Figure 3A:
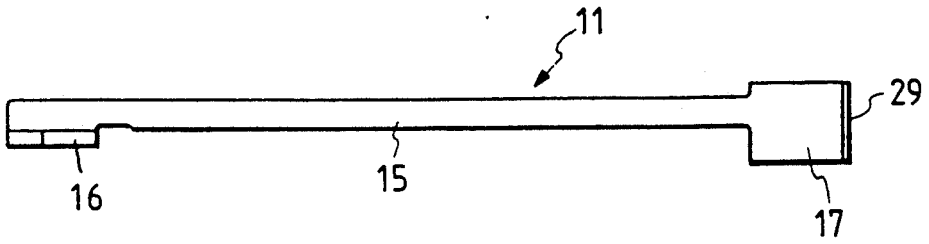
FIGS. 3*a, b* and *c* shows a knock over bit.
Figure 3B:
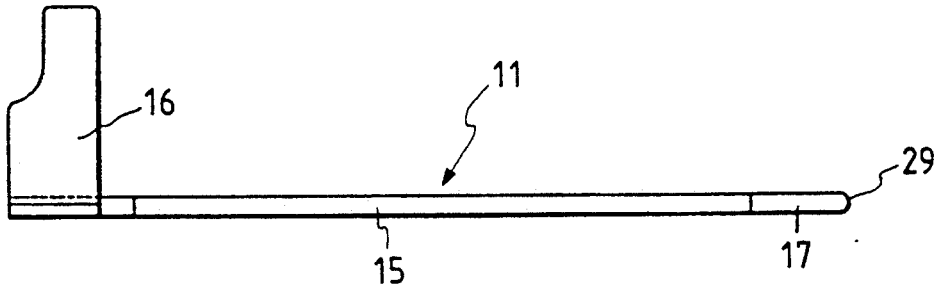
FIG. 3*b* is a front view.
Figure 3C:
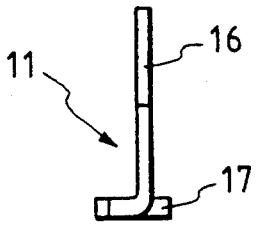
FIG. 3*c* is a side view.

FIGS. 1*a, b* shows an example in which the present invention is applied to a needle bed 1 in the form of a two-bed type, and only one side on a center line X—X positioned between the confronting two needle beds is shown. Needle plates 4 are inserted into needle grooves 3 juxtaposed on a base plate 2 of the needle bed 1, and a wire 7 is inserted between a notch 5 of the needle plate base plate 2 and a notch 6 of the needle plate 4 so that they are fixed. A needle groove 8 is formed between the needle plates 4 and 4 adjacent to each other. A guide recess 12 for slidably inserting a knock-over plate 11 therein is provided in a bottom 10 of the needle groove 8 of a head portion 9 of the needle bed, that is, in the upper surface of the needle bed base plate 2, and a needle 14 is inserted on a same plane as an upper surface 13 of the knock over plate 11 which is flush with the bottom 10 of the needle groove when the knock over plate 11 is inserted in the guide recess 12. As shown in FIGS. 3*a, b* and *c*, the knock over plate 11 has a butt 16 at a tail portion of a flat plate-like shank 15 on which the needle 14 is placed and a square loop pressing plate 17 at a head thereof. The knock over plate 11 is slidably fitted in the guide recess 12 of the needle bed base plate 2 so that the loop pressing plate 17 protrudes to a position somewhat protruded from the head portion 9 of the needle bed base plate 2, that is, to a position in the vicinity of the end edge of a sinker 18.

The sinker 18 is partly fitted into a sinker groove 19 provided at the same pitch and the same phase as that of the needle groove 3 at the extreme end of the head portion of the needle bed base plate 2, and a hook 20 provided at the end of the sinker 18 is locked at a notch 21 of the needle bed base plate 2 and connected and fixed by a wire 22. Reference numeral 23 denotes a band which passes through the juxtaposed needle plates 4, 4, . . . in order to prevent the needle 14 from being slipped out. Reference numeral 24 denotes a carriage which has a cam 26 for operating a needle jack 25 and a cam 27 in engagement with the butt 16 of the knock over plate 11.

When the knitted fabric is knitted by the above apparatus, to what extent the end edge 29 of the loop pressing plate 17 of the knock over plate 11 is moved forward from the needle bed base plate 2 is first determined in consideration of the kind, characteristic properties and the like of a knitting yarn 28 to be used. The forward movement of the loop pressing plate 17 is carried in a manner such that the knock over plate 11 is slidably moved through the butt 16 of the knock over plate 11 by means of the knock over plate cam 27. This sliding amount is determined by the shape of the knock over plate cam 27 of the carriage 24. Accordingly, the change of the forward position of the loop pressing plate 17 of the knock over plate 11 is carried out by the change of the knock over plate cam 27. Since the knock-over plate cam 27 guides the butt 16 while holding the butt 16 from both sides thereof, the loop pressing plate 17 moved forward by the knock over plate cam 27 is accurately positioned.

Figure 2:
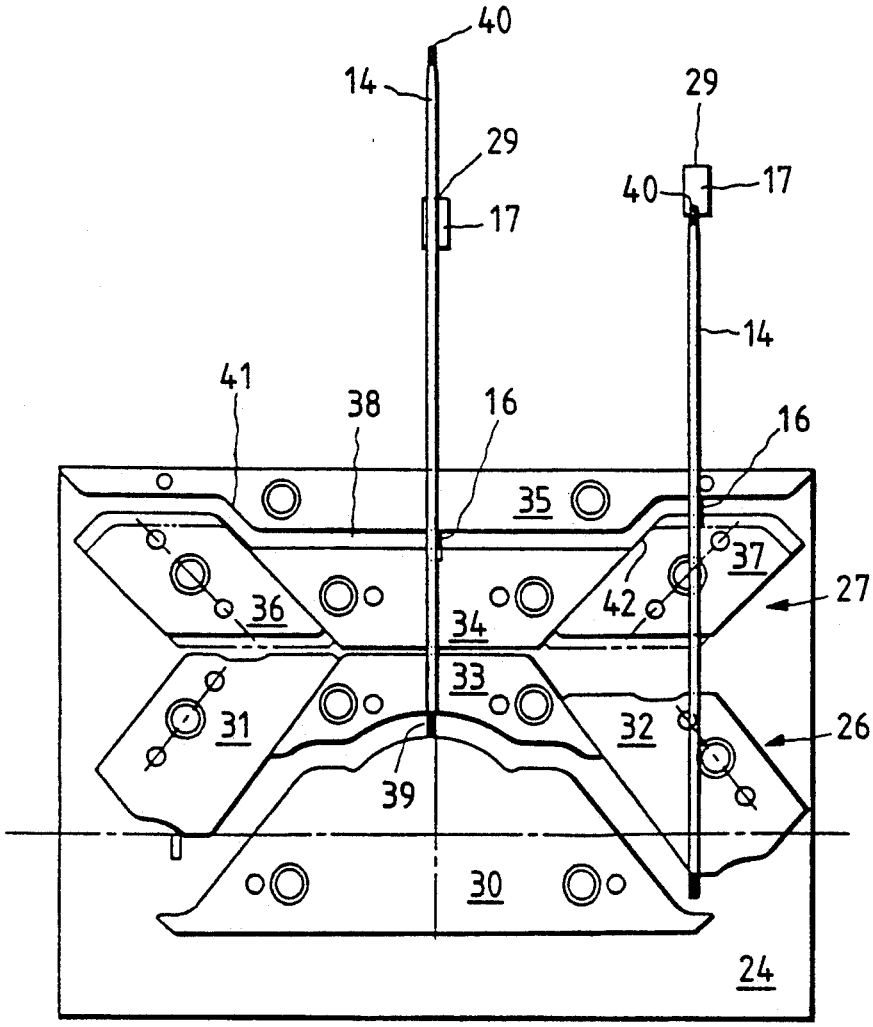
FIG. 2 is a plan view of a cam provided on a carriage.

FIG. 2 shows an arrangement of a cam of the carriage 24. The cam 26 for operating the needle 14 has a known construction in which knitting cams 31 and 32 and a guard cam 33 are arranged on both sides and on the top of a rising cam 30, and the knock over plate cam 27 is arranged at an upper position of the needle operating cam 26. The knock over plate cam 27 is provided with fixed cams 34 and 35 in the center and the upper and lower portion, and movable cams 36 and 37 which move up and down are provided on both wings of the fixed cam 34. A passage 38 of the knock over plate butt 16 is formed between the cams 36, 34, 37 and the cam 35. As the carriage 24 moves from right to left in FIG. 2 at the time of knitting of the knitted fabric, a hook 40 of the needle 14 is moved up and down by a needle butt 39 which is guided to the raising cam 30, the guard cam 33 and the knitting cam 32. At the same time, the butt 16 of the knock over plate 11 moves within the passage 38. When the needle 14 is moved forward by the cam 30, the cam 35 is pulled down along an oblique surface 41 of the cam 35 and is mot pulled down when the needle 14 moves up to a substantially tack position of the needle 14. It moves within the passage 38, during which the needle 14 moves most forwardly, and then starts to move down and the hook 40 receives feed of a knitting yarn. When the needle 14 starts to move down and moves down to a substantially tack position, the knock over plate butt 16 is moved upward by a rising surface 42 of the movable cam 37 to move forward the loop pressing plate 17. By the forward movement of the loop pressing plate 17, the end edge 29 of the loop pressing plate 17 comes into abutment with the old loop 43 engaged with the needle 14 to urge the old loop 43 toward the hook side of the needle 14. Since the knitting yarn 28 fed to the needle 14 is engaged with the hook 40 of the needle 14, the hook 40 passes through the old loop 43 while holding a knitting yarn 28 and is knocked over. Accordingly, the knock over position is moved away from the end of the needle bed base plate 2 to assume a forward position. The needle 14 is pulled down by the successive pull-down action of the knitting cam 32, the old loop 43 is knocked over, and the knitting yarn 28 locked at the hook 40 of the needle 14 forms a new loop 44. The above described knitting processes are shown in FIGS. 4*a* to 4*e*.

Figure 4A:
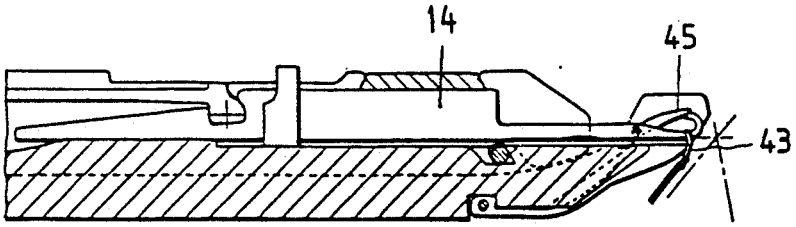
FIGS. 4*a* to 4*e* are respectively longitudinal sectional views of a needle bed successively showing the process of upward and downward movement of a needle and a knock-over plate.
Figure 4B:
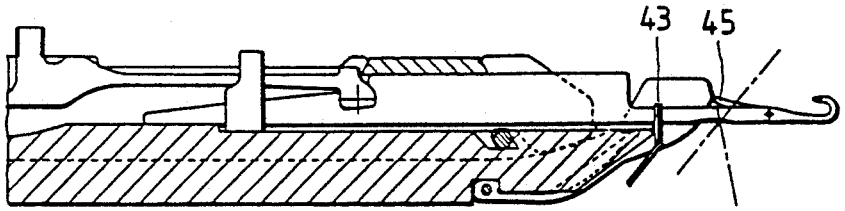
Figure 4C:
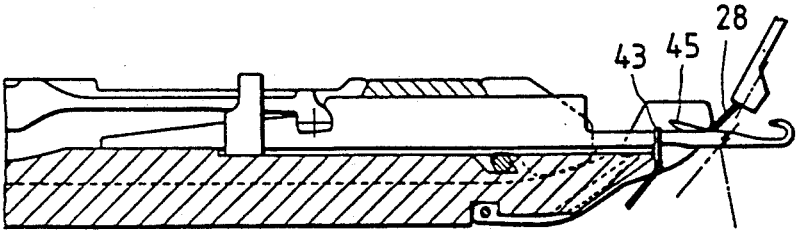
Figure 4D:
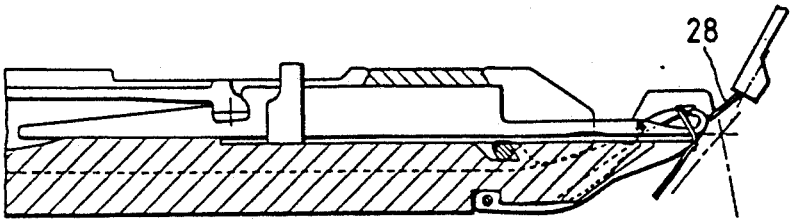
Figure 4E:
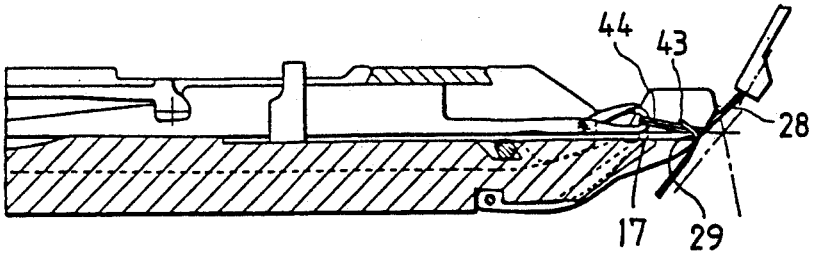

The position of the knock over operation is determined by the position of the end edge 29 of the loop pressing plate 17, and the position of the loop pressing plate 17 is determined by the position of the movable cam 37. Accordingly, it is necessary to adjust in advance the position of the movable cam 37 prior to knitting according to the yarn kind, yarn thickness, etc. of the knitting yarn. By this adjustment, suitable knock over timing is continuously and optionally obtained. A position at which a top end 45 of a latch of the raising needle 14 is passing through the old loop 43 is lowered by moving most backwardly the position of the end edge 29 of the loop pressing plate 17 when the needle 14 moves up as shown in FIG. 4*b*, and a position of the knock over is made higher than the position of the former, so that the elevating and lowering stroke of the needle 14 can be lessened.

As described in detail hereinabove, according to the present invention, a knock over plate provided at its extreme end with a loop pressing plate having an end edge in contact with a knitting yarn is inserted into a bottom of a needle groove of a head portion of a needle bed so that the knock over plate can be slidably moved in a direction of forward and backward movement of a needle. Therefore, the end edge in contact with the yarn of the knock over plate with respect to the hook of the needle moved forward when the knitted fabric is knitted can be suitably changed whereby the knock over timing can be adjusted and the elevating stroke of the needle can be lessened. The above described adjustment can be continuously changed by suitably changing the moving amount of the knock over cam.

What is claimed is:

1. A flat knitting machine, comprising:

a needle moveable in a forward direction and a backward direction, a needle bed comprising a head portion defining a needle groove having a bottom, a knock over plate positioned in the bottom of the needle groove of the head portion of the needle bed and being slidably moveable in the forward direction and the backward direction, the knock over plate comprising a loop pressing plate defining an end edge having an extreme end for contacting a knitting yarn, wherein the knock over plate comprises a flat plate-like shank defining a tail portion having a loop pressing plate, and wherein the knock over plate is slidably fitted in a guide recess of a needle bed base plate so that an end edge of the loop pressing plate extends between a position protruding from a head portion of the needle bed base plate and a position substantially adjacent an end edge of a sinker.

2. The machine of claim 1, wherein the bottom of the needle groove defines a guide recess into which the knock over plate is slidably insertable, wherein the knock over plate has an upper surface defining a plane that is flush with the bottom of the needle groove when the knock over plate is inserted in the guide recess, and wherein the needle is positioned on the plane defined by the upper surface of the knock over plate.

3. The machine of claim 1, comprising:

a carriage, and a knock over plate cam provided on the carriage for moving the knock over plate in a forward direction and in a backward direction.

4. The machine of claim 3, wherein the knock over plate cam is positioned for engagement with the knock over plate and wherein the position of the knock over plate cam is movable so as to vary the amount of movement of the knock over plate.

* * * * *